US007908972B2

(12) United States Patent
Brunn

(10) Patent No.: US 7,908,972 B2
(45) Date of Patent: Mar. 22, 2011

(54) FLARE-BANG PROJECTILE

(76) Inventor: Michael Brunn, Sea Cliff, NY (US)

( * ) Notice: Subject to any disclaimer, the term of this patent is extended or adjusted under 35 U.S.C. 154(b) by 704 days.

(21) Appl. No.: 11/827,619

(22) Filed: Jul. 12, 2007

(65) Prior Publication Data

US 2010/0212533 A1 Aug. 26, 2010

Related U.S. Application Data

(63) Continuation-in-part of application No. 11/328,753, filed on Jan. 10, 2006, which is a continuation of application No. 10/691,404, filed on Oct. 21, 2003, now Pat. No. 7,025,001.

(60) Provisional application No. 60/419,891, filed on Oct. 21, 2002, provisional application No. 60/807,173, filed on Jul. 12, 2006.

(51) Int. Cl.
*F42B 4/26* (2006.01)
*F42B 7/00* (2006.01)

(52) U.S. Cl. ..... 102/458; 102/346

(58) Field of Classification Search ..... 102/336–346, 102/444, 458
See application file for complete search history.

(56) References Cited

U.S. PATENT DOCUMENTS 3,058,420 A * 10/1962 Tanner et al. ..... 102/439
3,062,144 A 11/1962 Hori et al.
3,262,390 A * 7/1966 Cowles et al. ..... 102/458
3,323,456 A * 6/1967 Rothman ..... 102/346
3,349,707 A 10/1967 Wortley, Jr. et al.
3,473,472 A * 10/1969 Bliss et al. ..... 102/346
3,587,468 A * 6/1971 Bliss ..... 102/346
3,601,053 A * 8/1971 Grall et al. ..... 102/334
4,162,645 A * 7/1979 Abbott ..... 86/23
4,389,939 A * 6/1983 Ofuji ..... 102/458
4,448,130 A 5/1984 Speer
4,457,233 A * 7/1984 Hyde ..... 102/346
4,505,203 A * 3/1985 Brady et al. ..... 102/382
4,553,481 A * 11/1985 Ricci ..... 102/458
5,076,171 A 12/1991 Altenau et al.
5,090,326 A 2/1992 Altenau et al.
5,235,915 A * 8/1993 Stevens ..... 102/439
6,186,072 B1 * 2/2001 Hickerson et al. ..... 102/518
6,257,146 B1 * 7/2001 Stonebraker ..... 102/346
6,539,873 B2 * 4/2003 Diller ..... 102/458
7,025,001 B2 * 4/2006 Brunn ..... 102/502
7,610,857 B1 * 11/2009 Dunnam et al. ..... 102/458
2001/0007229 A1 7/2001 Dales
2004/0112242 A1 * 6/2004 Brunn ..... 102/498
2006/0032392 A1 * 2/2006 Menefee ..... 102/439
2006/0169165 A1 * 8/2006 Brunn ..... 102/502

FOREIGN PATENT DOCUMENTS

EP 555107 A2 * 8/1993

* cited by examiner

*Primary Examiner* — Troy Chambers
(74) *Attorney, Agent, or Firm* — Bennet K. Langlotz; Langlotz Patent & Trademark Works, Inc.

(57) ABSTRACT

A flare-bang projectile is comprised of a weighty ballast in the front leading edge, a flash-bang charge, a transfer charge and a flare charge that is lit by a starter composition located at the rear of the flare charge. When the flare charge is ignited such that it burns during the flight of the projectile, an the projectile path is indicated to thereby provide warning signaling.

43 Claims, 13 Drawing Sheets

FLASH-BANG USAGE
(PRIOR ART)

FLASH-BANG CARTRIDGE
(PRIOR ART)

FLASH-BANG CARTRIDGE
(PRIOR ART)

Crash-Bang Projectile #1

Crash-Bang Assembly #1
(Cartridge and projectile)

Crash-Bang Projectile #2
(With obturator)

Crash-Bang Assembly #2
(Cartridge and
projectile with obturator)

Crash-Bang Projectile #3
(Cardboard tube)

Crash-Bang Assembly #3
(Cartridge and
Cardboard Tube Projectile)

Crash-Bang Projectile #4
(Liquid Ballast)

Crash-Bang Assembly #4
(Cartridge and
projectile with liquid ballast)

FLARE-BANG PROJECTILE

RELATED APPLICATIONS

The present application claims priority from U.S. Provisional Application Ser. No. 60/807,173 filed Jul. 12, 2006 and is a continuation-in-part of U.S. patent application Ser. No. 11/328,753 filed Jan. 10, 2006, which is a continuation of U.S. patent application filed Ser. No. 10/691,404 filed Oct. 21, 2003, now U.S. Pat. No. 7,025,001 which claimed priority from U.S. Provisional Patent Application Ser. No. 60/419,891 filed Oct. 21, 2002, each of which are hereby incorporated by reference in their entirety.

BACKGROUND OF THE INVENTION

1. Field of the Invention

The present invention relates generally to the field of shotgun ammunition, and more particularly, to a shotgun cartridge capable of exploding with a loud noise and producing low mass, low energy fragments which do not pose a serious risk of injury to persons close to the explosion and which provides a bright visible light during flight of the cartridge to thereby provide visual signaling.

2. Description of the Related Art

In recent years, United States armed forces and law enforcement agencies have put a greater emphasis on creating "less-lethal" weaponry. The purpose of such weapons is not to kill, but to temporarily incapacitate or, in some cases, to deter the subject from further approach. As an example, the U.S. Marine Corps. has required a shotgun round capable of delivering a "flash-bang" air burst at ranges of 400 feet, 600 feet, and 800 feet. This less-lethal "flash-bang" cartridge was intended for crowd control and to determine intent at extended stand-off ranges.

"Flash-bang" shotgun cartridges, used mostly for frightening animals (particularly birds) away from a specific location, are well-known in the prior art. Flash-bang cartridges are fired like any other shotgun rounds (See, FIG. 1, taken from FIG. 1 of U.S. Pat. No. 3,323,456). However, these prior art flash-bang cartridges have several shortcomings which make them less than ideal as a less-lethal weapon or deterrent force.

U.S. Pat. No. 3,323,456 to Rothman (the '456 patent) discloses a flash-bang shotgun cartridge comprised of a propellant charge and a projectile. Referring to FIG. 2 (FIG. 3 of the '456 patent), the projectile assembly 27 contains flash-bang charge 43 sealed between seal 39 in the front of the assembly and ballistic weight 35 in the rear of the assembly (see, col. 4, line 65 to col. 5, line 30, '456 patent). Ballistic weight 35 "impart[s] a higher flight coefficient and thus [extends] the range of the projectile" (see, col. 5, lines 29-30, '456 patent), is comprised of powdered lead and zinc (see, col. 5, lines 2-6, '456 patent), and its center 33 holds a fuse cord 37, which is lit by the propellant charge 25 (see, col. 5, lines 64-65, '456 patent).

The '456 patent has a ballistic weight which extends the range of the projectile (to distances as great as 900 feet; see, col. 4, lines 6-12 and col. 6, lines 1-3); however, the '456 patent's weighty mass is located in the rear of the projectile, which causes tumbling in flight and, thus, inaccurate targeting.

U.S. Pat. No. 3,062,144 to Hori et al. (the '144 patent) discloses a flash-bang shotgun cartridge that has delay fuse powder in a hollow center cylinder in the back of the projectile. As shown in FIG. 3 (FIG. 4 of the '144 patent), the fuse powder charge 35 is enclosed within cylindrical casing 34, where the cylindrical casing 34 extends outwardly (from the projectile) to the propellant charge 25 and inwardly to the flash-bang charge 42 (see, col. 2, lines 42-49, '144 patent).

However, the '144 patent does not disclose a weighty mass positioned in the projectile for greater distance, accuracy, and stability. The front of the projectile according to the '144 patent has a chamber 48 which can hold powdered material 42 (see, FIG. 3). The only payload material suggested by the '144 patent for the forward chamber is an additional powder charge (see, col. 2, lines 61-65, '144 patent). Because of the lack of ballistic weight, the projectile described by the '144 patent can not achieve long or accurate trajectories, but will instead tumble in flight and fall quickly to the ground.

Therefore, there is a need for a flash-bang shotgun cartridge which has greater stability in flight, as well as greater accuracy in targeting. Furthermore, there is a need for a flash-bang cartridge which will have a minor concussive effect upon a target, without causing serious harm.

SUMMARY OF THE INVENTION

One object of the present invention is to provide a shotgun cartridge which has greater stability in flight, as well as greater accuracy in targeting, than prior art flash-bang cartridges.

Another object of the present invention is to provide a shotgun cartridge which will have a minor concussive effect upon a target, without causing serious harm.

These and other objects are accomplished by the present invention which provides a shotgun cartridge with a frangible, but weighty, ballast that disintegrates into small, low mass, low energy (and therefore less-lethal) fragments which are useful as a deterrent at extended ranges (i.e., 900 feet). The cartridge is essentially comprised of an outer tube, a propellant charge, and a projectile. The projectile is comprised of the weighty ballast in the front, the flash-bang charge at one end of the projectile, a transfer charge, a flare compound, and then, in the rear, a starter composition, which is lit by the detonation of the propellant charge to aid burning of the aid in ignition of the flare compound upon being fired.

The ballast provides stability in flight, more accurate targeting, and greater distances traversed by the shotgun projectile. The ballast can be any weighty, yet frangible, material which can provide stability and inertia during flight and still disintegrate into low mass low energy fragments which are less capable of injuring impacted flesh. The ballast is preferably comprised of a combination of zinc and graphite powder, although it can be comprised of lead or tungsten particles, and is contained the end of the projectile and a closure, preferably a wad or separation disc glued in place or created by the application of epoxy resin to a side of the ballast.

The transfer charge is consolidated into a through hole in a charge cup that is centrally located at an end opposite to the location of the ballast, where the ballast is contained in the charge cup. As a result, it becomes possible to produce a "base burner" effect whereby drag is reduced around the rear of the projectile by the gasses generated from the burning of the transfer charge. The range of the projectile is determined by changing the amount of transfer charge and/or the amount of propellant charge. In one embodiment, a range of 900 feet is possible with a delay of 5 seconds.

The flare charge is lit by the starter composition located at the rear of the flare charge. Once the flare charge is ignited, it burns during the flight of the projectile, indicating the projectile path to thereby provide a warning signaling. In alternative embodiments, different flare charge colors are used to provided other types of signaling.

Other objects and features of the present invention will become apparent from the following detailed description considered in conjunction with the accompanying drawings; whereas the various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

The foregoing and other advantages and features of the invention will become more apparent from the detailed description of the preferred embodiments of the invention given below with reference to the accompanying drawings in which.

DETAILED DESCRIPTION OF THE EXEMPLARY EMBODIMENTS

Figure 1:
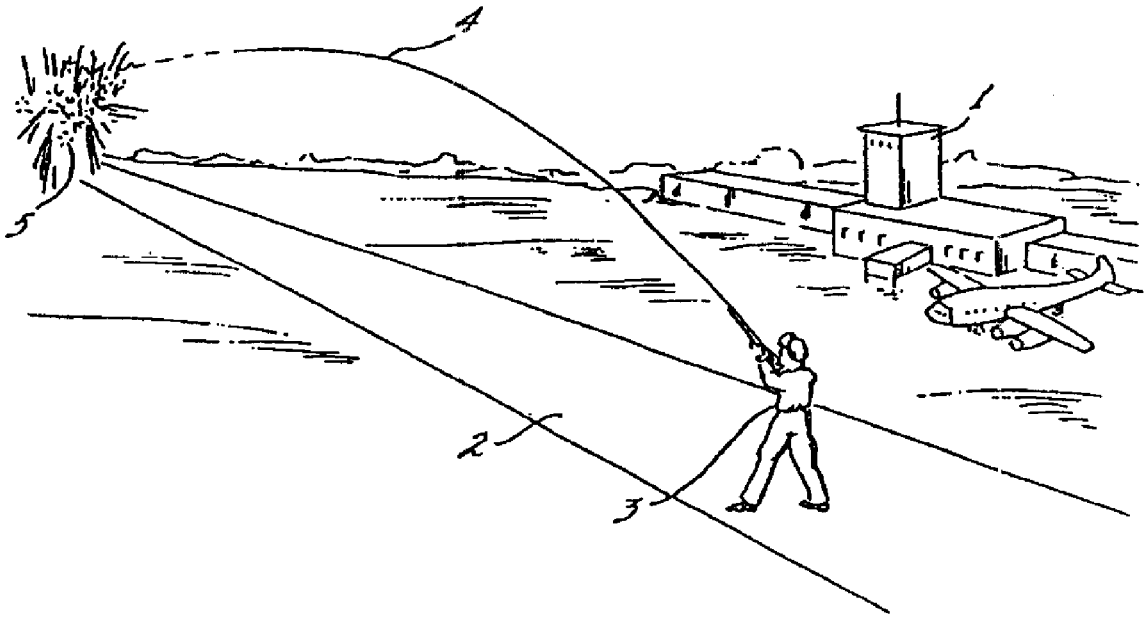
FIG. 1 show an exemplary use of a flash-bang shotgun cartridge in the prior art.
Figure 2:
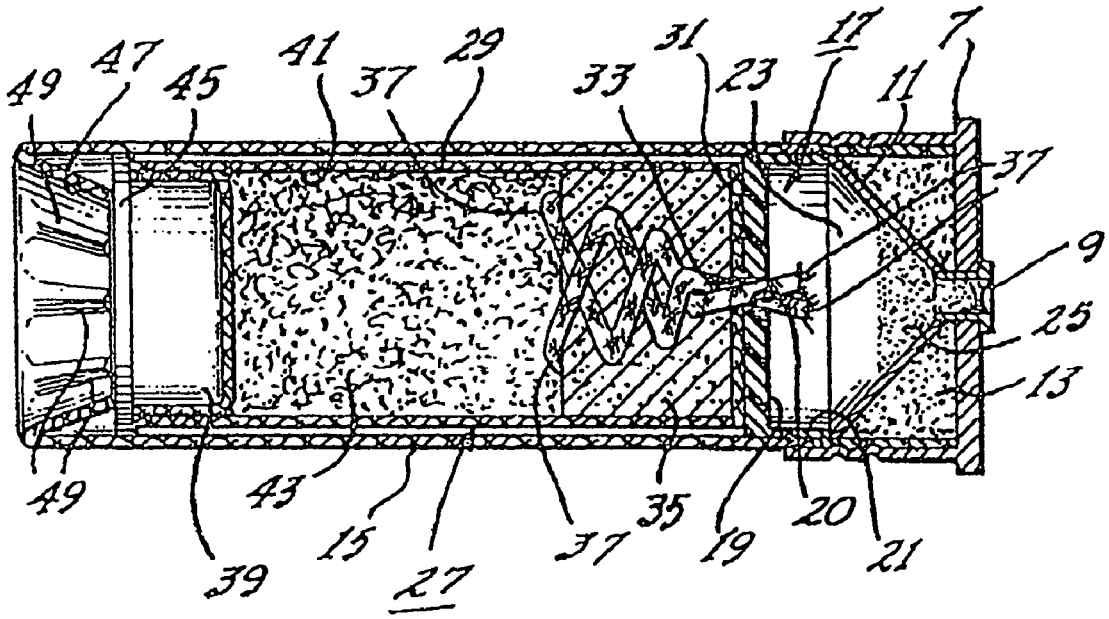
FIG. 2 show a prior art flash-bang shotgun cartridge.
Figure 3:
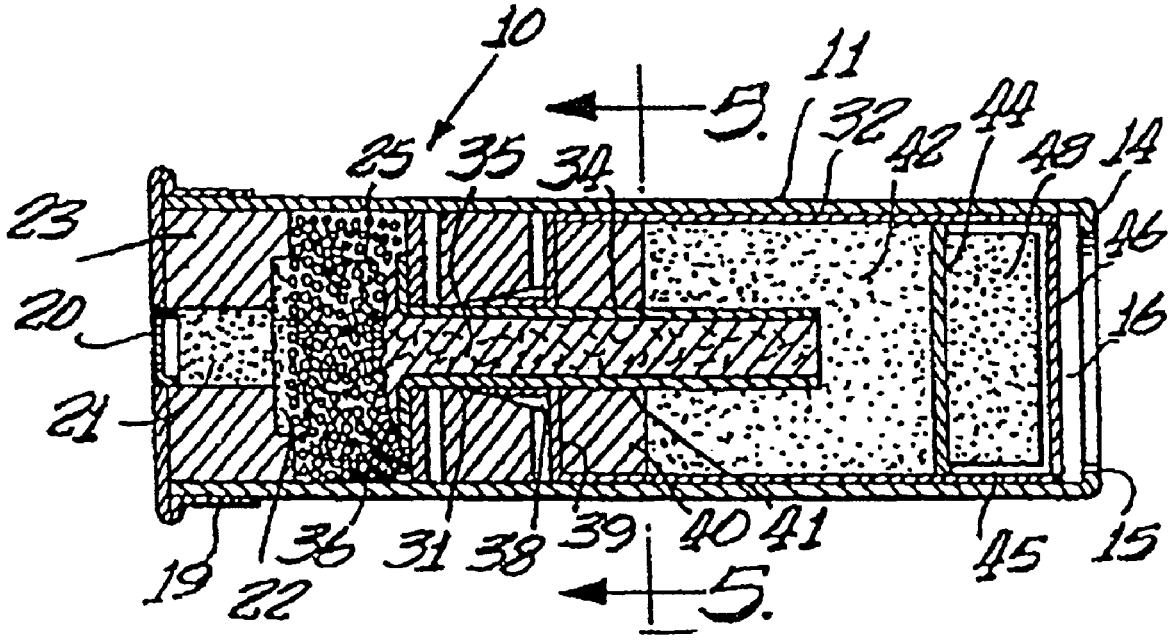
FIG. 3 show another prior art flash-bang shotgun cartridge.

The presently preferred embodiments of the present invention were originally developed in response to a U.S. Marine Corps request for shotgun rounds capable of delivering a "flash-bang"-type air burst at ranges of 400 feet, 600 feet and 800 feet. The rounds were intended for less-lethal use both as a deterrent and as a means for determining the intent of potentially hostile groups at extended stand off ranges. The following design requirements were set forth in the U.S. Marine Corps request:

1. Standard shotgun shell cartridges were to be used;
2. Standard propelling methods were to be used, i.e., igniting nitrocellulose based smokeless propellants in the shot shell (no miniature rocket motors); and
3. Projectile must disintegrate into low energy fragments upon detonation.

There is a key problem when attempting to meet this combination of requirements. The desire for a projectile that can travel up to 800 feet requires a fairly heavy weight as ballast, because a low weight projectile loses velocity rapidly and then falls to the ground. The desire for a less-lethal projectile requires that, when the projectile detonates, only low mass fragments are expelled. Thus, the added mass for stability and distance must not become dangerous high mass projectiles upon detonation.

In order to fulfill these objectives, several preferred embodiments of the present invention were conceived and/or manufactured by the inventor. In these preferred embodiments, a frangible, but weighty, ballast is situated at the leading edge of the projectile, thus providing the extra weight and inertia required for achieving the extended range, while lessening the risk of lethal injury of people in the vicinity of the detonation because of the frangibility of the ballast. In the preferred embodiments of the crash-bang projectile, the frangible mass comprising the ballast disintegrates into small, low mass, and therefore low energy, fragments when exposed to the stress and shock of the detonation of the flash charge. The low mass and therefore low energy fragments resulting from projectile detonation is a critical characteristic of this less-lethal round. If there were high mass fragments, they could be propelled to high velocities by the force of the detonation, thereby the posing risk of serious injury to persons in close proximity to the detonation.

The frangible ballast according to the preferred embodiments of the present invention provides the necessary weight and inertia to achieve the extended ranges possible with the preferred embodiments of the present invention. In addition, because the frangible ballast is positioned at the leading edge of the crash-bang projectile, the center of gravity of the crash-bang projectile is moved forward, thereby greatly improving the in-flight stability of the crash-bang projectile. Trajectory and accuracy are also improved. Prior art flash-bang cartridges which have a weighty ballast, such as the projectile described in the '456 patent, locate the ballast in the rear of the projectile, which causes tumbling in flight and, thus, inaccurate targeting as well as reduced trajectory because of the added drag. In addition, the additional mass of the frangible ballast in the crash-bang projectile provides sufficient containment for the efficient burn of nitrocellulose based smokeless powders.

Although the impetus for creating the preferred embodiments were the requirements of the U.S. Marine Corps listed above, it should be understood that the present invention is not limited by those requirements, and that certain embodiments of the present invention, while still falling within the scope of invention claimed in the claims appended herein, may not meet all or any of those requirements. However, the presently preferred embodiments do indeed meet those requirements.

As stated in the summary section above, the term "crash-bang" has been chosen as a name for the inventive cartridge and projectile to highlight the fact that the present shotgun cartridge is intended for "crash"-ing into potentially hostile forces with less-lethal force, rather than "flash"-ing and "bang"-ing in the vicinity of wildlife with the purpose of scaring away said wildlife. In addition, the term "Flare-Bang" as a name for the inventive cartridge and projectile to highlight the fact that the present shotgun cartridge is intended for "flare"-ing to provide a warning indicator. The preferred embodiments of the present invention were made with the intention of balancing the interest of not causing harm to any crowd of potential antagonists, while still providing a deterrent effect in order to protect those launching the less-lethal projectiles according to the preferred embodiments. It is the detonation of the flash charge in the crash-bang or flare-bang projectile which is intended to cause the concussive effect among the potentially hostile crowd, not the frangible ballast.

The presently preferred embodiments are intended to assist personnel in determining the intent of a group, or even possibly an individual, who appear to be approaching the position of the personnel. In addition to alerting the approaching potentially hostile group as to the personnel's presence, the preferred embodiments are intended to "warn off" the approaching individuals from continuing their approach. The low-mass, low-energy fragments produced by the detonation of the frangible ballast of the preferred embodiments of the present invention greatly diminish the risk of injury. In addition, the visible light provided by the flare-bang project provides a visible warning indicator that increases the effective of the of the preferred embodiments of the present contemplated embodiments. By comparison, high mass, high energy fragments would be expected from detonating another high-mass, i.e., heavy or weighty, object acting as a ballast, rather than the inventive frangible ballast of the present invention. Although the preferred embodiments are not intended to harm, and are designed to avoid lethal injury, there is still the possibility of lethal injury when using any explosive ballistic projectile, including embodiments of the present invention, and therefore the term "less-lethal" is used in regards to the present invention, and not "non-lethal".

Figure 4A:
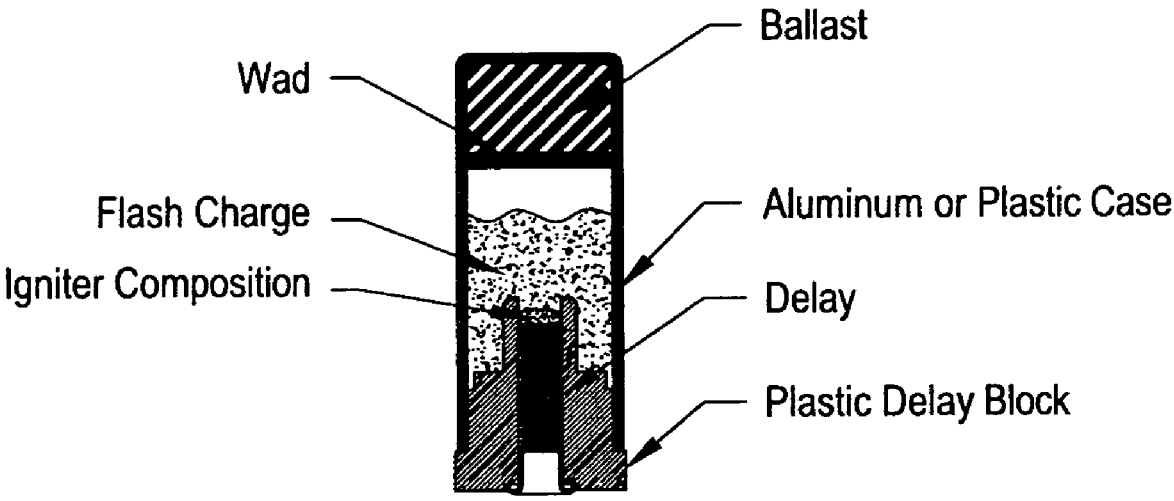
FIGS. 4A and 4B show a crash-bang cartridge projectile and assembly, respectively, according to a first preferred embodiment of the present invention.
Figure 4B:
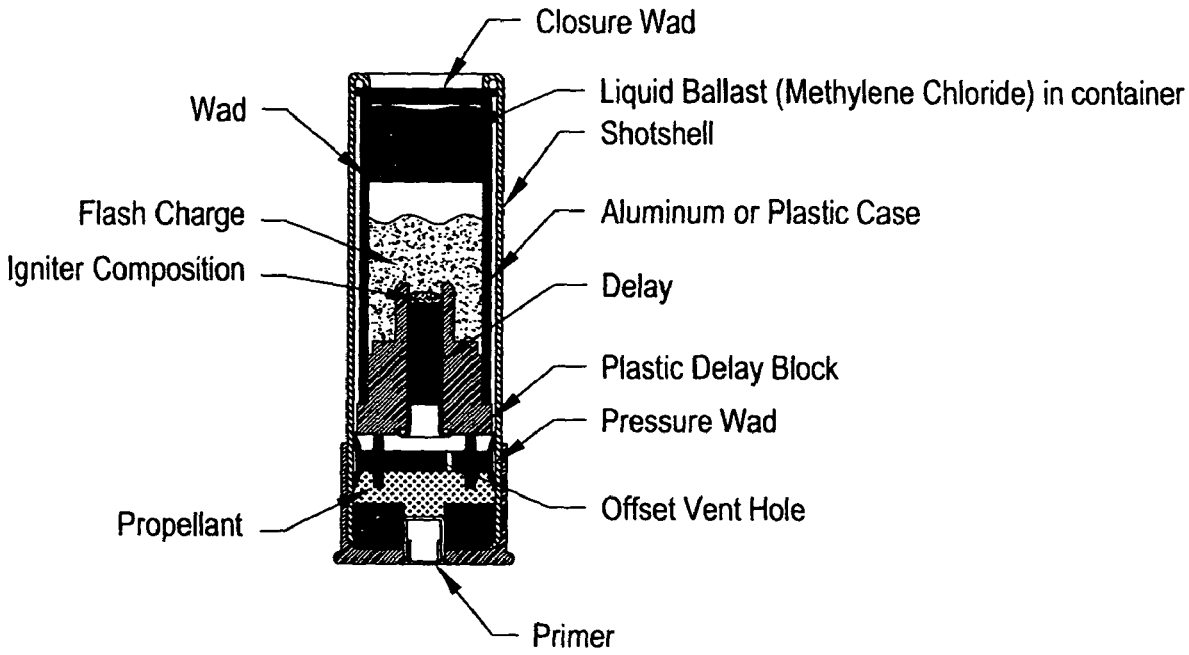

A crash-bang projectile and crash-bang cartridge assembly (comprised of the crash-bang projectile within the crash-bang cartridge) according to a first preferred embodiment of the present invention are shown in FIGS. 4A and 4B, respectively. In the first preferred embodiment according to the present invention, the walls of the projectile are formed of aluminum (or plastic), and the frangible ballast is held in place in front of the crash-bang projectile primarily by previous consolidation, but also by a wad securing the consolidated mass.

Figure 5A:
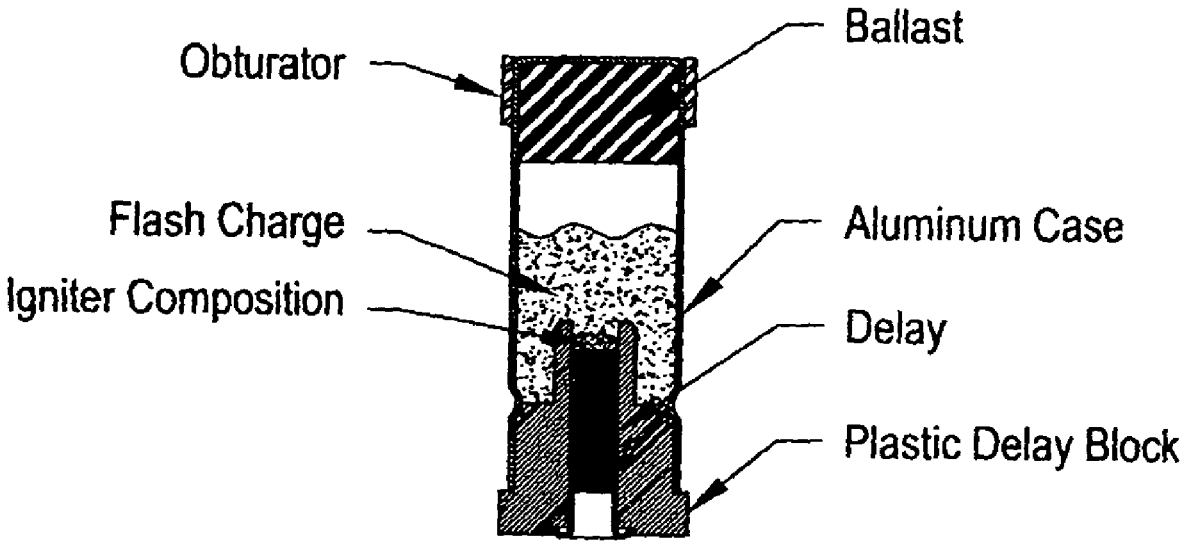
FIGS. 5A and 5B show a crash-bang cartridge projectile and assembly, respectively, where the projectile has an obturator according to a second preferred embodiment of the present invention.
Figure 5B:
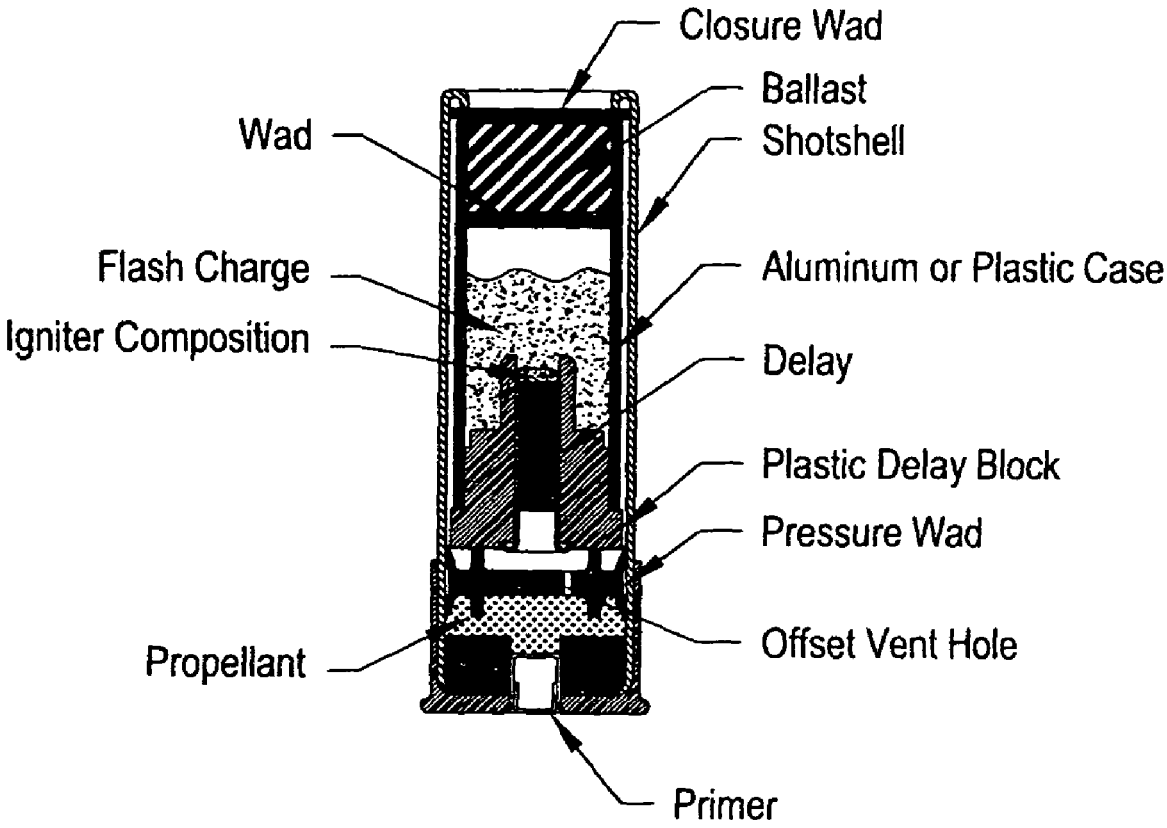

A crash-bang projectile and crash-bang cartridge assembly according to a second preferred embodiment of the present invention are shown in FIGS. 5A and 5B, respectively. In the second preferred embodiment, the walls of the projectile are made from aluminum, and an obturator is added at the end of the crash-bang projectile. Furthermore, the ballast is consolidated at the front of the aluminum projectile, but not secured by a wad.

Figure 6A:
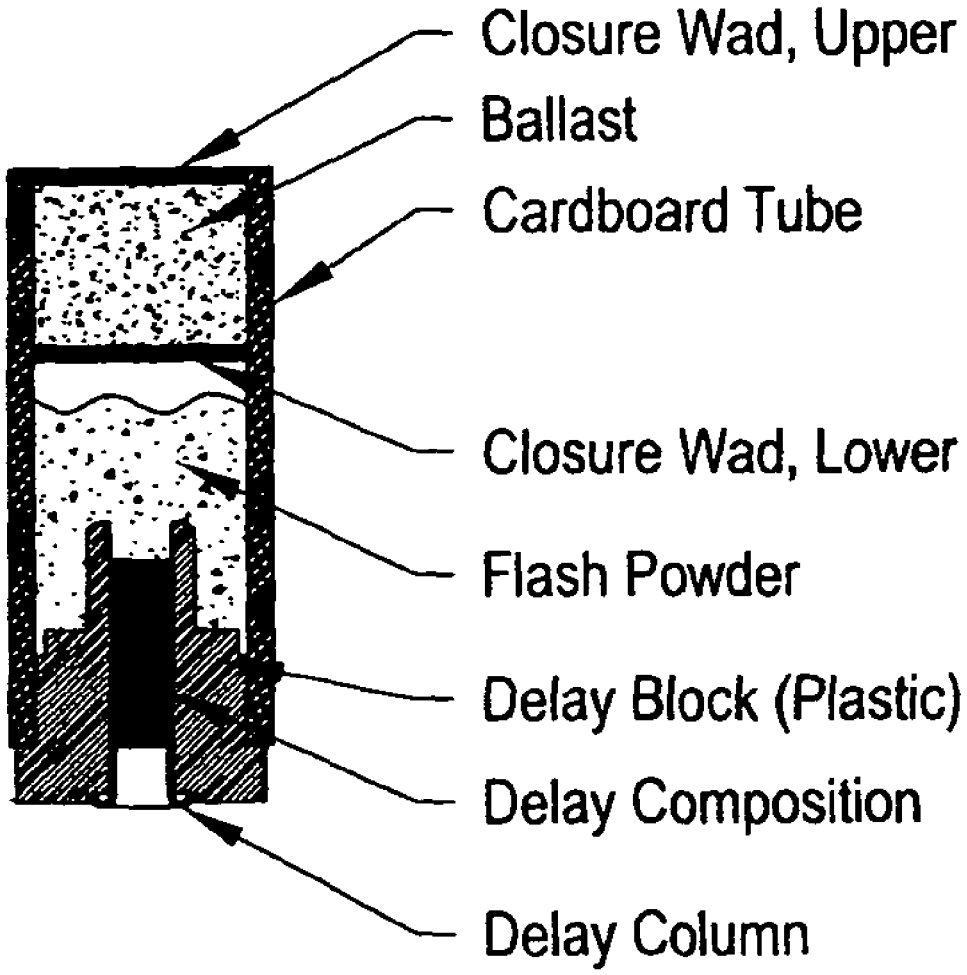
FIGS. 6A and 6B show a crash-bang cartridge projectile and assembly, respectively, where the projectile is comprised of a cardboard tube according to a third preferred embodiment of the present invention.
Figure 6B:
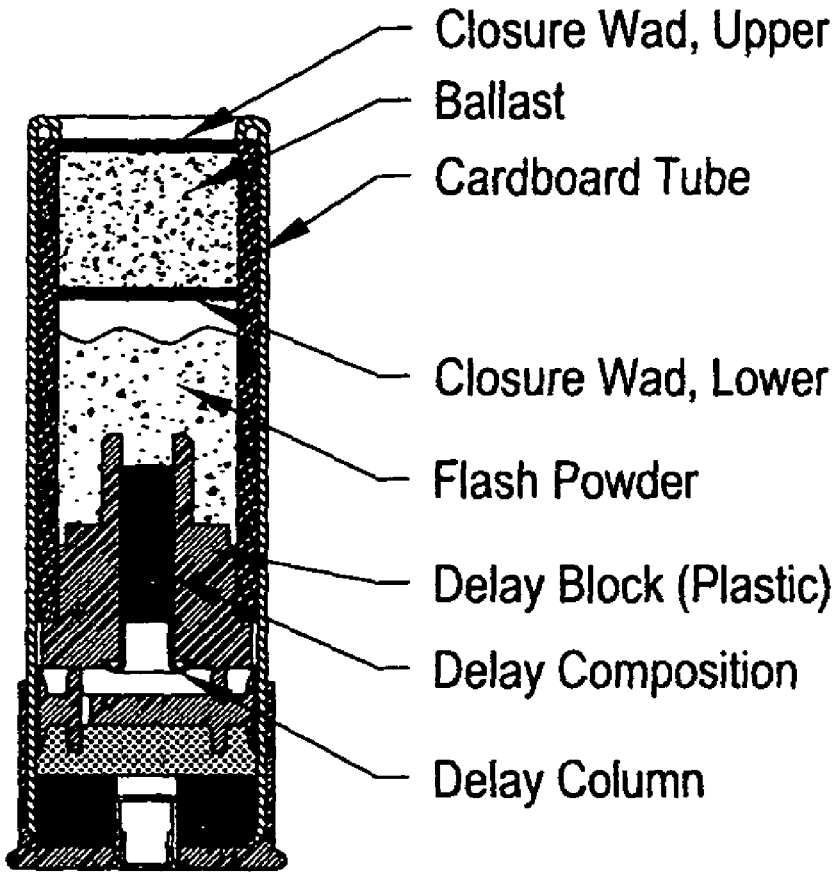

A crash-bang projectile and crash-bang cartridge assembly according to a third preferred embodiment of the present invention are shown in FIGS. 6A and 6B, respectively. In the third preferred embodiment, the crash-bang projectile is contained in a cardboard tube, and the consolidated ballast is held in place between two closure wads at the leading edge of the cardboard tube.

Figure 7A:
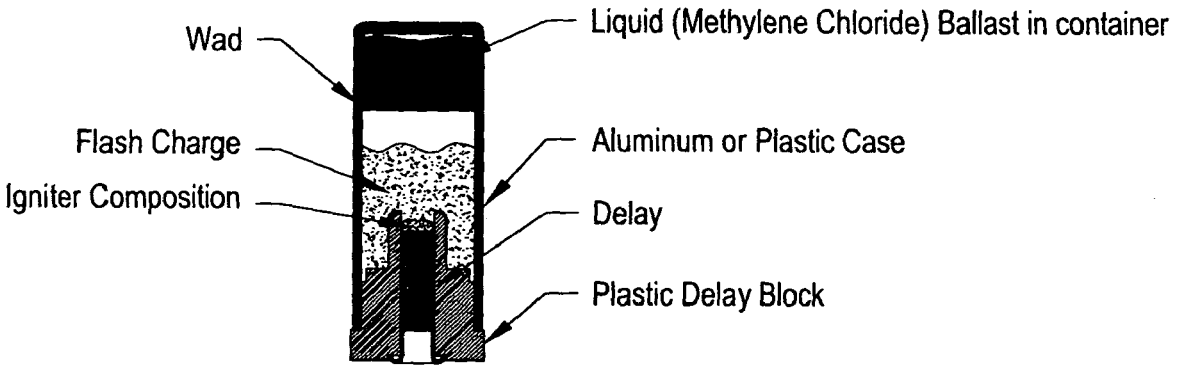
FIGS. 7A and 7B show a crash-bang cartridge projectile and assembly, respectively, where the ballast is comprised of a liquid according to a fourth preferred embodiment of the present invention.
Figure 7B:
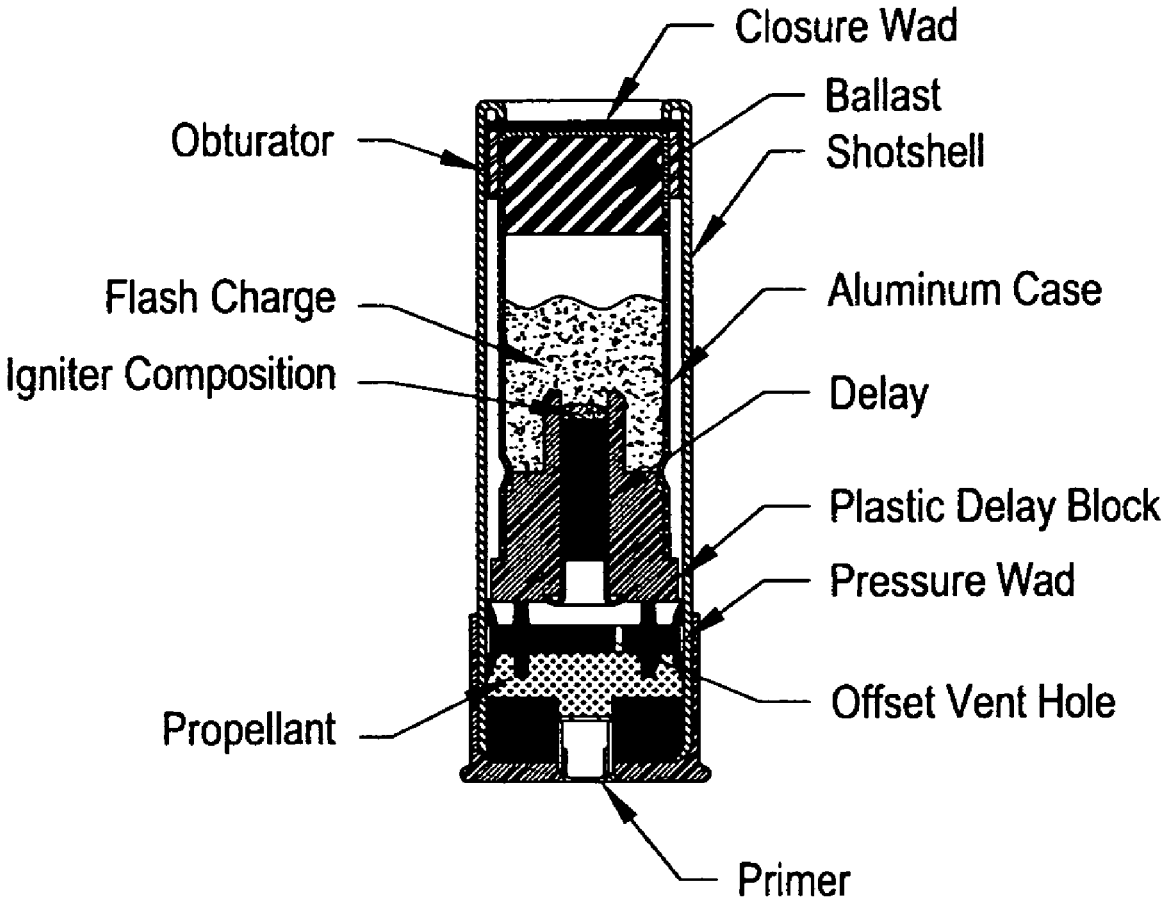

A crash-bang projectile and crash-bang cartridge assembly according to a fourth preferred embodiment of the present invention are shown in FIGS. 7A and 7B, respectively. In the fourth preferred embodiment, the crash-bang projectile is contained in an aluminum (or plastic) case, and the frangible ballast is comprised of a container of liquid (methylene chloride) secured at the leading edge of the crash-bang projectile with a wad.

Although the body of the crash-bang projectile is made of either aluminum or cardboard in the preferred embodiments of the present invention, it should be noted that any material with the appropriate characteristics may be used in accordance with the present invention. For example, the body could be made from plastic or rubber, provided that the body adequately disintegrated upon detonation of the flash charge. Aluminum was found preferable because cardboard, as used in the third preferred embodiment, would sometimes collapse upon itself due to the forces of acceleration generated when launched. However, impregnating the cardboard with resin would likely alleviate this problem. Aluminum is also preferred because it participates in the chemical reaction in the detonation of the flash charge in the crash-bang projectile. The detonation of the flash powder in the preferred embodiments comprises a chemical reaction of aluminum powder with an oxidizer. In the first, second, and fourth embodiments, at least some of the aluminum of the crash-bang projectile case is consumed in the flash charge detonation along with the aluminum powder.

FIG. 4A is a cross-section of the projectile portion of the crash-bang cartridge according to the first preferred embodiment of the present invention. The projectile shown is approximately one and % inch tall and roughly 7/10 of an inch in diameter. The other embodiments described here are substantially in the same dimensional range, although much larger and much smaller sizes (for different caliber weapons) are possible in accordance with the present invention. The frangible ballast can be seen at the forward edge of the aluminum case, or cup, of the crash-bang projectile, being secured by a wad between it and the flash charge in the center of the crash-bang projectile.

In the presently preferred embodiments, the ballast is comprised of a mixture of zinc powder and a small amount of graphite powder consolidated in the leading edge of the projectile. In order to set the ballast in the projectile case, or cup, the ballast materials are first poured into the projectile cup, and then a ram is used to press the loose ballast material into a consolidated mass. The graphite powder acts as a lubricant, coating the zinc particles and preventing them from bonding to each other too strongly during consolidation, thus creating a frangible solid mass. In the presently preferred embodiments, the degree of frangibility of the ballast mass is controlled by the ratio of zinc to graphite and the level of consolidation pressure. It is important to note that consolidation of the ballast material is not absolutely necessary for the present invention.

The frangible ballast in the presently preferred embodiments comprises zinc particles in order to increase density and provide more volume for the explosive charge. However, any frangible yet adequately dense material both capable of providing adequate ballast for stability and distance and capable of disintegrating into low mass, low energy fragments upon detonation may be used in accordance with the present invention. For example, heavier materials, such as unconsolidated lead particles (not favorable because of environmental problems), unconsolidated tungsten particles (not favorable because it is expensive), or other such materials that yield similar results, or combination of materials that yields similar results, may be used in accordance with the present invention. Liquids may be used, as shown in the fourth preferred embodiment, described more fully below. In short, any single solid, fluid, or gaseous material, or any combination of solids, fluids, and/or gasses, could comprise the ballast as long as the features of weight and frangibility as described herein are maintained.

The flash charge in the presently preferred embodiments is comprised of about 2.5 to about 4.5 gram mixture of aluminum powder, magnesium powder, and potassium perchlorate.

Variations of the formulation of the flash charge, as well as the quantity, are possible in accordance with the present invention, including, for instance, the use of black powder, as would be known to one skilled in the art. The igniter composition, which is used to ignite the flash charge, in the presently preferred embodiments is comprised of about 35 to about 65 mg mixture of zirconium powder, red iron oxide, titanium powder, and nitrocellulose binder, but, once again, any appropriate igniter mixture, in any appropriate quantity, may be used, as would be known to one skilled in the art. It is possible not to have any igniter composition in embodiments of the present invention, thereby allowing the flash charge to be ignited directly from the end of the delay column.

The igniter mixture is itself ignited by the delay column contained within the plastic delay block. The delay column is lit when the crash-bang projectile is propelled out of the crash-bang cartridge (and the shotgun barrel) by the ignition of the propellant charge in the crash-bang cartridge (shown in FIG. 4B). The delay composition in the presently preferred embodiment is comprised of a roughly 10 grain mixture of black powder and a zirconium-nickel delay composition, but any appropriate delay mixture, in any appropriate weight, can be used, as would be known to one skilled in the art. For example, it is contemplated that granules of magnesium may be added to the delay composition in order to create a "tracer" effect as the projectile is in flight.

A relatively long delay must be provided in order to achieve detonation at the contemplated extended ranges. A delay of 5 seconds will detonate the projectile at a range of approximately 900 feet from the point of fire. Lesser ranges can be achieved by shortening the delay and/or decreasing the propellant charge (in the crash-bang cartridge, FIG. 4B).

Consolidated delay columns provide for accurate and repeatable delay times. Furthermore, it is believed there is the added benefit of a "Base Burner" effect when using this kind of delay composition. Typically, turbulence often occurs behind the trailing edge of a projectile, which dramatically increases drag. However, if a base burner fuse is used at the rear of the projectile, the expanded gasses reduce the drag on the rear of the projectile. As stated above, the delay composition preferably comprises a consolidated column of zirconium nickel powder or standard fuse powder (fine gun powder) or a combination of both. However, any mixture of elements adequate for providing a delay fuse, as would be known to one skilled in the art, would be in accordance with the present invention.

Prior art cartridges do not, and can not, take advantage of the base burner effect. For example, the fuse in the '456 patent is a cord fuse in the center of the weighty mass, rather than a powder delay fuse formed in a cylinder in the back of the projectile. Thus, the burning gasses generated by this embedded fuse will not have the benefits of the "base burner" effect. Furthermore, although it appears the location of the fuse in the projectile according to the '144 patent would cause the base burner effect, it is extremely unlikely that it would have that effect in real life, because the '144 projectile has no ballast to cause the stability necessary for the rear portion to remain in that orientation during flight. In other words, the '144 projectile would be tumbling out of control for lack of ballast, and, in such a situation, any gasses from the burning fuse would not reduce drag.

FIG. 4B is a cross-section of the complete crash-bang cartridge assembly, comprised of the crash-bang projectile contained within the crash-bang cartridge, according to the first preferred embodiment of the present invention.

The crash-bang projectile of FIG. 4A can be seen inside the crash-bang cartridge of FIG. 4B, supported in the front by a closure wad, and in the rear by a pressure wad. The crash-bang cartridge according to the preferred embodiments is the shape of a standard shotgun shell and is capable of being loaded and fired from a standard shotgun. The front end of the cartridge is crimped inwards in order to seal in the contents of the crash-bang cartridge with the closure wad. An adhesive may be used to seal the closure wad in place. Although not strictly necessary, the use of the closure wad in addition to the crimping of the end of the cartridge creates a waterproof barrier between the outside elements and the contents inside the cartridge. Besides the roll-crimping shown in FIG. 4B, any type of crimping or effective sealing in accordance with the present invention, including, for example, star-crimping, can be used.

The pressure wad is located between the crash-bang projectile and the propellant and primer at the rear of the crash-bang cartridge. The pressure wad protects the rear of the crash-bang projectile, and, in particular, the delay column in the crash-bang projectile, from the exploding pressure of the propellant. An offset vent hole in the pressure wad vents some of the heat and pressure from the ignition of the propellant charge and thereby lights the delay column of the crash-bang projectile before it takes flight. The offset location of the vent hole insures that the delay column will not be damaged by the release of hot gasses through the vent hole. In some presently preferred embodiments, there is a primer in the delay block which is ignited by the hot gasses, and which, in turn, ignites the delay fuse composition. In other presently preferred embodiments, the escaping hot gasses light the delay fuse composition directly.

The primer is located in the standard position for a shotgun cartridge in the presently preferred embodiments. The propellant charge in the crash-bang cartridge of the presently preferred embodiments is comprised of about 10 grains of Red Dot smokeless powder, although any appropriate propellant charge mixture could be used in accordance with the present invention, and in any appropriate quantity. As discussed above, it may be desirable to vary the quantity of propellant charge in order to change the intended range of the crash-bang projectile. The range may also be changed by varying the delay composition in the crash-bang projectile. Furthermore, although the U.S. Marine Corps. requirements mention that standard propelling methods are to be used (i.e., nitrocellulose based smokeless propellants) for the projectile, a crash-bang cartridge according to the present invention may use any propelling method (including using miniature rocket motors) adequate for the task, as would be known to one skilled in the art.

The additional mass of the frangible ballast in the crash-bang projectile provides sufficient containment for the efficient burn of nitrocellulose based smokeless powders when they are used as the propellant charge. One problem with smokeless powders is that they need a certain amount of external pressure during ignition in order to ignite properly. Without adequate pressure, the powder may not burn properly, resulting in powder from the propellant charge being dispelled unignited with the projectile. This unignited powder can blow back in the face of the one who fired the cartridge. In the presently preferred embodiments, the mass of the frangible ballast assures that there is sufficient resistance to, and therefore sufficient pressure on, the propellant charge during ignition so that there is an efficient burn.

Table 1 below summarizes some of the differences between the prior art flash-bang shotgun cartridges and the first preferred embodiment of the inventive crash-bang shotgun projectile and cartridge:

TABLE 1

| Characteristic | Flash-Bang Cartridge | First Preferred Embodiment of the Super Long Range Crash-Bang Cartridge |
|---|---|---|
| Projectile Weight | 7.1 grams | 21.5 grams |
| Explosive Charge | 1.6 grams | 4.0 grams |
| Maximum Range | 210 feet | ~900 feet |
| Fragmentation | Low energy, low mass cardboard and resin particles | Low energy, low mass cardboard, zinc, and plastic particles |
| Propellant | Nitrocellulose based Smokeless powder | Nitrocellulose based Smokeless powder |
| Efficiency of propellant burn | Low, due to light projectile mass and lack of pressure buildup; leaves unburned propellant residue in barrel | High: full burn with no appreciable residue in barrel |
| Ballistic Accuracy | Mediocre: not aerodynamically shaped or balanced | Good: center of gravity is forward; stable flight |
| Delay Consistency | Low: fuse cord is inaccurate in short lengths | Good: consolidated delay column provides consistent delays |

The first preferred embodiment is presently the most preferred of the four embodiments.

A crash-bang projectile and crash-bang cartridge assembly according to a second preferred embodiment of the present invention are shown in FIGS. 5A and 5B, respectively. In the second preferred embodiment, an obturator comprised of a protuberance extending out from the circumference on outside of the front portion of the cup of the crash-bang projectile.

The obturator is used to increase the diameter of the projectile in order to create a tighter fit with the inner surface of the barrel of the shotgun (or, in other embodiments, whatever weapon is launching the crash-bang cartridge). The tighter fit between the projectile and the shotgun barrel further stabilizes the projectile when being launched. In addition, in barrels having rifling, or in a shotgun barrel having a rifled choke attached at the end, the obturator serves to engage the rifling on the inside of the barrel. If the walls of the projectile cup are fairly thin, the obturator also serves to protect the thin-walled projectile from the rifling, which normally cuts a groove in the outer surface of the projectile being launched. When the crash-bang projectile has thin walls, this may result in the projectile cup being pierced and the flash charge igniting prematurely, either in the barrel or on the way to the target.

In the first preferred embodiment, the diameter of the projectile is slightly larger, and the walls of the projectile cup are slightly thicker, thereby substantially eliminating the problems that the obturator solved in the second preferred embodiment. As can be seen by comparing FIG. 5B and FIG. 4B, the crash-bang projectile according to the first preferred embodiment has a greater diameter, thereby giving the entire projectile a much tighter fit within the shotgun barrel, as well as having slightly thicker walls, thereby providing a sufficiently thick skin so that it will not be pierced by rifling.

Another difference between the first preferred embodiment and the second preferred embodiment is the lacking of a closure or containment wad between the frangible ballast and the flash charge in the front of the projectile cup according to the second embodiment, as can be seen in either of FIG. 5A or 5B. The consolidation of the frangible ballast in the front of the aluminum projectile cup provides adequate cohesion to keep the ballast in place, without being secured by a wad. This wad-less construction is possible in the other embodiments, but it is preferable to have a closure wad securing the consolidated frangible mass.

A crash-bang projectile and crash-bang cartridge assembly according to a third preferred embodiment of the present invention are shown in FIGS. 6A and 6B, respectively. In the third preferred embodiment, the aluminum cup of the first two embodiments is replaced with a cardboard tube, which, as can be seen in FIG. 6B, fits snugly within the crash-bang cartridge. An upper closure wad seals in the frangible ballast at the front end of the place of the crash-bang projectile, while a lower closure wad seals in the frangible ballast from the flash charge on the inside of the crash-bang cartridge. Consolidation is achieved by pressing a ram over the loose material poured into the cardboard tube. The frangible ballast is contained between the two closures to ensure that the material will remain in place even if it cracks or crumbles due to rough handling or due to the shock of being fired. Two methods have been successfully used for sealing in the frangible mass: cardboard wads (discs) glued in place (as shown in FIGS. 6A and 6B) and the application of epoxy resin layers to both sides of the ballast. Other methods are possible, as would be known to one skilled in the art.

As mentioned before, one disadvantage of the cardboard tube is its inability to hold up to the accelerative force that is applied during the firing of the propellant charge. The cardboard walls would sometimes collapse under the strain. However, as also was pointed out above, the use of resin or a similar substance to impregnate the walls of the cardboard tube could adequately buttress the cardboard tube against the effects of acceleration. The use of an impregnating substance may have other disadvantages, such as flammability.

A crash-bang projectile and crash-bang cartridge assembly according to a fourth preferred embodiment of the present invention are shown in FIGS. 7A and 7B, respectively. In the fourth preferred embodiment, a nylon container holds a liquid ballistic mass at the front end of the crash-bang projectile. In this embodiment, the liquid ballast is comprised of methylene chloride, which becomes an aerosol and then evaporates when the flash charge detonates. The methylene chloride is held in a nylon container (see inset of FIG. 7B), which also disintegrates when the flash charge is detonated. Other suitable liquid ballasts, and liquid ballast containers, may be used in accordance with the present invention, as long as the liquid can be appropriately less-lethally dispersed, and the container may be appropriately less-lethally destroyed, as would be known or surmised to one skilled in the art. Methylene chloride is presently used as a carrier for irritants in other less-lethal munitions. It is possible that, in other embodiments of the present invention, the methylene chloride could act as a carrier for an irritant for delivery at the detonation point of the crash-bang projectile.

Figure 8:
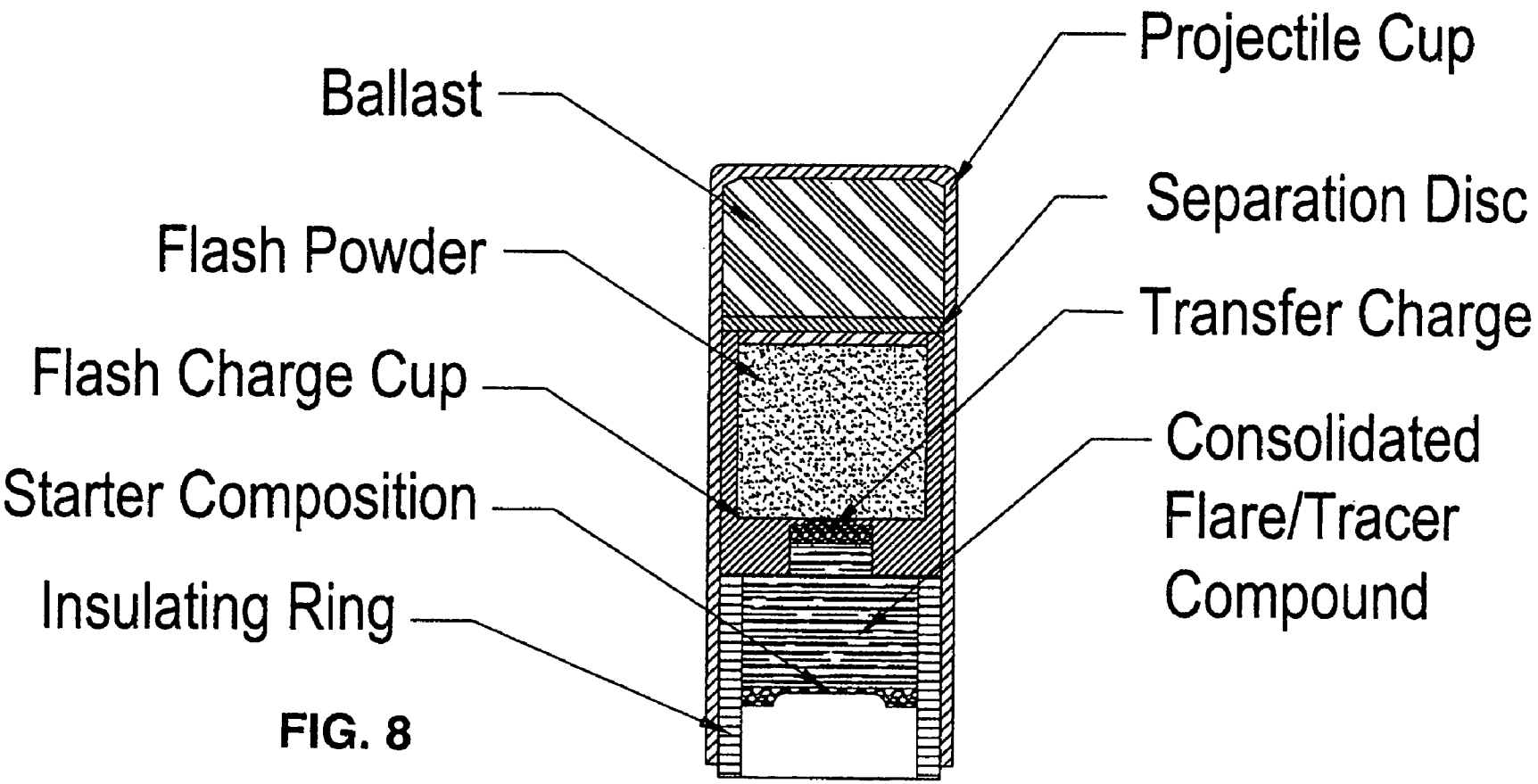
FIG. 8 shows a flare-bang cartridge projectile in accordance with an alternative embodiment of the present invention.
Figure 9:
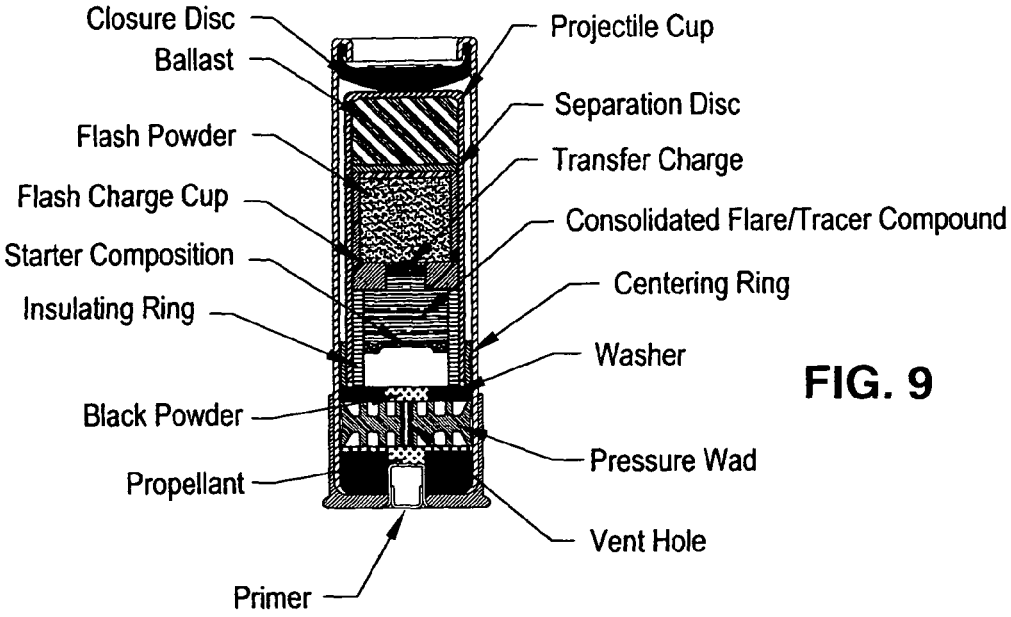
FIG. 9 shows the flare-bang cartridge projectile of FIG. 8 when inserted in a conventional shot gun shell.

A flare-bang projectile and flare-bang cartridge assembly (comprised of the flare-bang projectile with a standard shotgun shell) according to another preferred embodiment of the present invention is shown in FIG. 8 and FIG. 9, respectively. In accordance with the present contemplated embodiment, the projectile is configured to fit within a standard shotgun shell, such as a 12 gauge or 10 gauge types. In the present contemplated embodiments, the walls of the projectile are formed of aluminum (or plastic), and the frangible ballast is held in place in front of the crash-bang projectile primarily by previous consolidation, but also by a wad or separation disc securing the consolidated mass. Although the body of the flare-bang projectile is made of either aluminum or cardboard in the preferred embodiments of the present invention, it should be noted that any material with the appropriate characteristics may be used in accordance with the contemplated embodiments.

As shown in FIG. 8, it is the projectile cup that houses the major components of the flare-bang projectile assembly of the present contemplated embodiment. With specific reference to FIG. 8, the closed end or leading edge of the projectile cup contains the frangible ballast to make the projectile nose heavy to improve the flight characteristics of the assembly, in accordance with the disclosed embodiments of the invention.

The ballast of the present contemplated embodiments is also comprised a mixture of zinc powder and a small amount of lubricant, such as graphite, which is consolidated into the closed end or leading edge of the projectile cup. In order to set the ballast in the projectile case, or cup, the ballast materials are first poured into the projectile cup, and then a ram is used to press the loose ballast material into a consolidated mass. The graphite powder acts as a lubricant, coating the zinc particles and preventing them from bonding to each other too strongly during consolidation, thus creating a frangible solid mass. In the presently preferred embodiments, the degree of frangibility of the ballast mass is also controlled by the ratio of zinc to graphite and the level of consolidation pressure. It is important to note that consolidation of the ballast material is not absolutely necessary for the present invention.

The frangible ballast in the presently preferred embodiment also comprises zinc particles to increase density and provide more volume for the explosive charge. However, any frangible yet adequately dense material both capable of providing adequate ballast for stability and distance and capable of disintegrating into low mass, low energy fragments upon detonation may be used in accordance with the contemplated embodiments.

The ballast is further secured and isolated from the other components by a wad or separation disc. Located next to this separation disk is a flash charge cup that contains the flash charge or powder. The flash charge in the present contemplated embodiments is preferably comprised of about 2.5 to about 4.5 gram mixture of aluminum powder, magnesium powder, and potassium perchlorate. Variations of the formulation of the flash charge, as well as the quantity, are possible in accordance with the contemplated embodiments, including, for instance, the use of black powder, as would be known to one skilled in the art.

A transfer charge is consolidated into a through hole (not shown) in the charge cup that is centrally located at an end opposite to the location of the ballast to ensure detonation of the flash charge upon "burn out" of the flare compound or consolidated flare/tracer compound.

In accordance with the preferred embodiments, the transfer charge composition, which is used to ignite the flash charge, is also comprised of about 35 to about 65 mg mixture of zirconium powder, red iron oxide, titanium powder, and nitrocellulose binder, but, once again, any appropriate igniter mixture, in any appropriate quantity, may be used, as would be known to one skilled in the art. For example, a delay fuse may be used to provide detonation of the ballast and it is not the intention to limit the contemplated embodiments to configurations in which only a transfer charge compound is used.

The flare/tracer compound is consolidated or rammed into an insulating ring which is located inside the interior perimeter of the projectile cup, at the open end. The insulating ring protects the projectile from disintegrating while the flare/tracer compound burns during flight. A layer of consolidated starter composition is then used to cover the consolidated flare/tracer compound. The starter composition aids in the ignition of the flare/tracer compound upon firing of the projectile when it is loaded into a standard shotgun round, such as the assembly shown in FIG. 9, where a centering ring is placed around the projectile assembly during final assembly of the shotgun round.

With further reference to FIG. 9, during use a shotgun firing pin (not shown) strikes the primer which causes the primer to fire and ignite the propellant. Pressure from the burning propellant propels the projectile assembly through the barrel of the shot gun and downrange. While the projectile assembly is in flight, flame from burning propellant is communicated through a vent hole in the pressure wad to black powder located next to the consolidated starter composition, which then ignites the starter composition that will burn through, which, in turn, ignites the consolidated flare/tracer compound. At this point, bright, visible light is generated during the burning of the flare/tracer compound, indicating the projectile flight path to thereby provide a warning signaling.

It should be readily appreciated that the color of the light is dependant on the specific compound used. For example, the following exemplary compounds may be used in the formation of the flare/tracer compound that helps to produce different color light. In order to obtain a flare/tracer compound that burns green, barium carbonate ($BaCO_3$) may be used as a green color agent, barium chlorate ($BaClO_3$) may be used as an oxidizer in green color compositions, barium nitrate ($Ba(NO_3)_2$) may also be used as both a green color agent and an oxidizer and barium sulfate ($BaSO_4$) may be used as a high-temperature oxidizer in metal-based green color compositions. Calcium carbonate (e.g., chalk) may be used as a color agent in orange compositions.

In order to obtain a flare/tracer compound that burns green, barium carbonate ($BaCO_3$) may be used as a green color agent, barium chlorate ($BaClO_3$) may be used as an oxidizer in green color compositions, barium nitrate ($Ba(NO_3)_2$) may also be used as both a green color agent and an oxidizer and barium sulfate ($BaSO_4$) may be used as a high-temperature oxidizer in metal-based green color compositions.

In order to obtain a flare/tracer compound that burns orange, calcium carbonate (e.g., chalk) may be used as a color agent in orange compositions, as well as Calcium Sulfate ($CaSO_4.xH_2O$, where x=0, 2, 3, 5) or calcium sulfate anhydrate (where x=0) that may be used as a high temperature oxidizer in orange color compositions. In addition, Lampblack (carbon black) (C) may be used to produce long lasting, finely dispersed orange sparks.

In order to obtain a flare/tracer that burns blue, copper acetoarsenite (paris green) ($Cu_3As_2O_3Cu(C_2H_3O_2)_2$) may be used, or copper benzoate [$Cu(C_6H_5COO)_2$] may be used as a fuel in blue colored flare/tracer compositions. It is also possible to use copper(II) carbonate ($CuCO_3$) as a blue color agent or copper chlorate (Hexahydrate) ($Cu(ClO_3)2.6H_2O$) which is used as an oxidizer in blue color compositions. Other compounds for producing a blue burning flare/tracer compound include copper(II) chloride (campfire blue) ($CuCl_2$), copper(II) oxide ($CuO$), copper oxychloride ($3CuO.CuCl_2.3.5H_2O$), copper(II) sulfate (Pentahydrate) ($CuSO_4.5H_2O$) or copper Benzoate ($Cu(C_6H_5COO)_2$).

In order to obtain a yellow burning flare/tracer compound, cryolite (sodium fluoaluminate) ($Na_3AlF_6$] white powder may be used as a yellow color agent. In addition, ferrotitanium (for example, a 60/40 ratio of Fe and Ti) may be used to create yellow-white light. Others that may be used include, Iron (Fe), Lactose (milk sugar) ($C_{12}H_{22}O_{11}.2H_2O$), sodium nitrate (chile saltpeter) ($NaNO_3$), Sodium Oxalate ($Na_2C_2O_4$).

For the color red, strontium carbonate ($SrCO_3$) may be used as the red color agent, strontium nitrate ($Sr(NO_3)_2$) may be used as the oxidizer in red color compositions. Another composition that may be used is strontium sulfate ($SrSO_4$), which may be used as a high-temperature oxidizer in red the color compositions.

Lastly, titanium (Ti) metal or Zinc (Zn) may be used in the flare/tracer compound to produce white colored sparks. Naturally, it will be appreciated that magnesium (Mg) may be used, where a coarser grade of magnesium would be used to produce the white sparks. It should also be noted that although extensive, the foregoing compounds are not exhaustive, that other compounds may be used to form the flare/tracer, and that it is not the intention of the present inventor to be limited to the foregoing list of compounds. Typically, red tracer would be used in a warning device, while other colors, such as green or white, would be used for other signaling purposes.

Finally, the transfer charge is ignited towards the end of the flare/tracer burn and, in turn, the flash charge is initiated to produce a bright flash and loud report at the terminal range in accordance with the disclosed embodiments of the crash-bang projectiles. Typically, the flare/tracer compound is formulated such that a timed burn may be obtained. In alternative embodiments, varying burn times are produced. In the preferred embodiments, burn times over a distance in excess of 300 meters is achieved.

Figure 10:
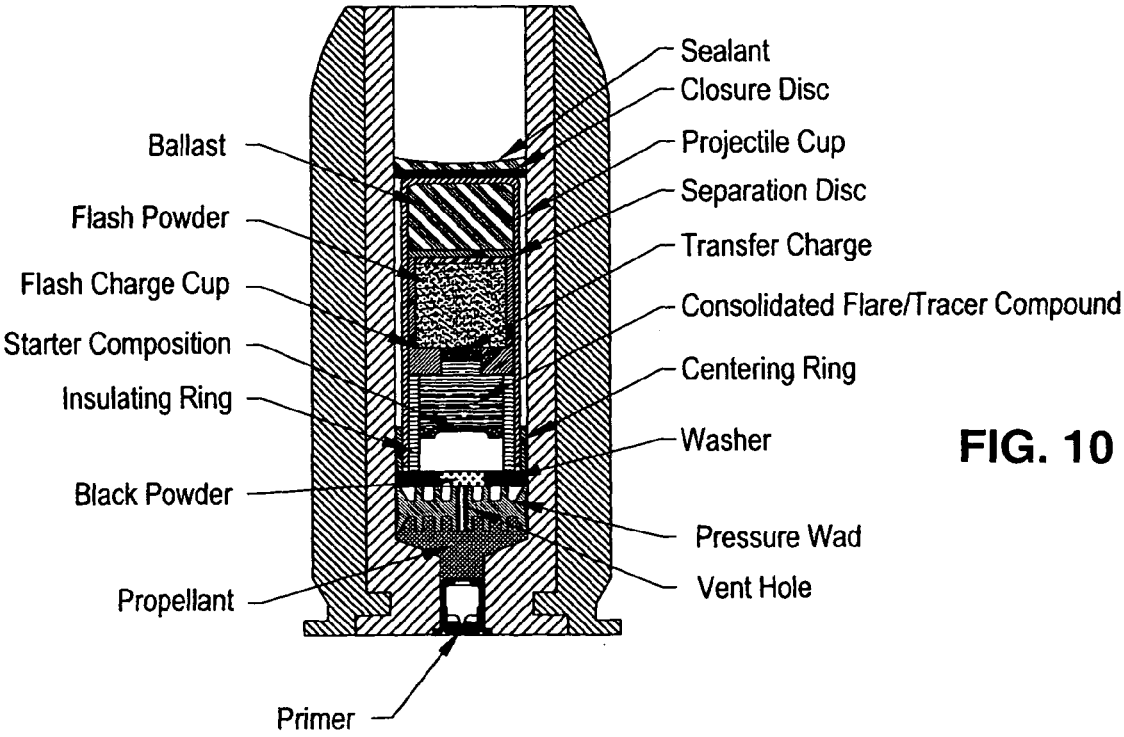
FIG. 10 shows a 40 mm version of the flare-bang cartridge projectile inserted in a 40 mm case having interior dimensions identical to standard shotgun shells and the outer dimensions of a 40 mm cartridge.

In another embodiment, a "40 mm version" of the projectile cap is similarly loaded into a 40 mm case having interior dimensions identical to standard shotgun shells and the outer dimensions of a 40 mm cartridge, as shown in FIG. 10. Such a 40 mm cartridge is associated with military grenade caliber for grenade launchers. In the U.S., there are currently two main types of grenade launchers that are in service, e.g., the 40×46 mm, which is a low-velocity round used in infantry grenade launchers; and the more powerful 40×53 mm, used in heavier, mounted and crew-served weapons. As a result, a grenade having a flare-bang capability in accordance with the contemplated embodiments that can be used in a grenade launcher is achieved. In the currently contemplated embodiment, however, the projectile assembly is held in the cartridge by a closure disc and sealant (see FIG. 10), instead of a plug cap held in place by a roll crimp shown in FIG. 8.

It is to be noted that the terms "frangible" and "frangibility" when used in reference to the present invention in the instant application is meant to indicate the characteristic of turning into low energy, low mass components when a charge is detonated within a certain proximity, such that the low energy, low mass components are unlikely to cause a lethal injury to people (or animals) near the point of detonation. Thus, the terms "frangible" and "frangibility" are not intended to limit the material of the ballast according to the present invention to solid or semi-solid objects.

In closing, the several preferred embodiments of the present invention provide a crash-bang projectile and cartridge, in which a frangible, but weighty, ballast is situated at the leading edge of the crash-bang projectile; thereby providing the extra weight and inertia required for achieving longer distances, while still lessening the risk of lethal injury of people in the target area. In the preferred embodiments, the frangible ballast disintegrates into small, low mass, and therefore low energy, fragments when the flash charge detonates. In addition, the ballast provides greater stability in flight, as well as greater accuracy when aiming at a target. Furthermore, the construction of the crash-bang projectile allows for a "base burner" effect when in flight, which is achieved by embodiments that incorporate a flare/tracer compound to provide warning signaling.

While there have shown and described and pointed out fundamental novel features of the invention as applied to presently preferred embodiments thereof, it will be understood that various omissions and substitutions and changes in the form and details of the substances, constructions, and orientations illustrated and described, and in their operation, may be made by those skilled in the art without departing from the spirit of the invention. For example, it is expressly intended that all combinations of those elements which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

I claim:

1. A flare-bang cartridge assembly, comprising:

a tubular cartridge; and a projectile within said tubular cartridge, said projectile comprising:

a tubular projectile casing;

a flare compound located at one end of the tubular projectile casing, said flare compound having a starter compound at one end for igniting said flare compound;

a transfer charge located at an opposite end of the flare compound, said transfer charge comprising a delay fuse composition; and a flash charge within said projectile casing, said flash charge being ignited by said transfer charge; and a weighty and frangible ballast located on a leading edge of said projectile, at an end of the tubular projectile casing opposite from the end having the flare compound, wherein a weight of said ballast is sufficient to provide stability and accuracy in flight, and wherein an at least one material comprising the weighty and frangible ballast is sufficiently frangible such that, after burning of said flare compound and after subsequent detonation of said flash charge, the at least one material comprises low mass, low energy components.

2. The flare-bang cartridge assembly of claim 1, wherein the low mass, low energy components comprising the weighty and frangible ballast after detonation are less likely to cause injury to any creature in a vicinity of said detonation.

3. The flare-bang cartridge assembly of claim 1, wherein the weighty and frangible ballast and flare compound are consolidated.

4. The flare-bang cartridge assembly of claim 1, wherein the at least one material comprising the weighty and frangible ballast is consolidated.

5. The flare-bang cartridge assembly of claim 4, wherein the at least one material comprising the weighty and frangible ballast remains substantially within the end of the tubular projectile casing by means of said consolidation.

6. The flare-bang cartridge assembly of claim 1, wherein the weighty and frangible ballast further comprises metallic particles.

7. The flare-bang cartridge assembly of claim 6, wherein the metallic particles form a metallic powder.

8. The flare-bang cartridge assembly of claim 6, wherein the weighty and frangible ballast is secured at the end of the tubular projectile casing by a wad or separation disc.

9. The flare-bang cartridge assembly of claim 1, wherein the tubular projectile casing forms a cup and the end of the tubular projectile casing where the weighty and frangible ballast is located forms a solid end of the cup, and wherein the metallic particles comprising the weighty and frangible ballast is consolidated at said solid end of the cup by pressing a ram over the metallic particles.

10. The flare-bang cartridge assembly of claim 1, wherein the weighty and frangible ballast further comprises at least one of lead particles and tungsten particles.

11. The flare-bang cartridge assembly of claim 1, wherein the at least one material comprising the weighty and frangible ballast comprises a mixture of zinc powder and graphite powder.

12. The flare-bang cartridge assembly of claim 11, wherein the graphite powder in the mixture of zinc and graphite powder coats the zinc particles comprising the zinc powder in said mixture and prevents said zinc particles from bonding too closely together.

13. The flare-bang cartridge assembly of claim 11, wherein the ratio of zinc powder to graphite powder controls a degree of frangibility of the weighty and frangible ballast.

14. The flare-bang cartridge assembly of claim 1, wherein the tubular projectile casing comprises at least one of aluminum, plastic, rubber, and cardboard.

15. The flare-bang cartridge assembly of claim 1, wherein said transfer charge is located proximate to the flash charge, said transfer charge comprising an igniter composition, wherein said igniter is ignited by the flare compound.

16. The flare-bang cartridge assembly of claim 1, further comprising:

a primer at one end of said tubular cartridge;

propellant in said tubular cartridge for launching the projectile from said tubular cartridge, said propellant being ignited by said primer; and a pressure wad between said propellant and said projectile.

17. The flare-bang cartridge assembly of claim 16, wherein an end of the tubular cartridge opposite from said end of the tubular cartridge having the primer is crimped inward to seal the projectile within the tubular cartridge.

18. The flare-bang cartridge assembly of claim 17, further comprising:

a closure wad sealing the projectile within the tubular cartridge, wherein said crimping at least assists in keeping said closure wad in place.

19. The flare-bang cartridge assembly of claim 1, wherein the projectile further comprises:

a container for the at least one material comprising the weighty and frangible ballast.

20. The flare-bang cartridge assembly of claim 1, wherein the projectile further comprises:

an insulator surrounding the flare compound for providing protection to the projectile from the ignited flare compound.

21. A flare-bang projectile, said flare-bang projectile fitting within a flare-bang cartridge in order to form a flare-bang cartridge assembly, comprising:

a tubular projectile casing;

a flare compound located at one end of the tubular projectile casing;

a starter compound at one end of the tubular casing;

a transfer charge located at an opposite end of the flare compound;

a flash charge within said tubular projectile casing; and a weighty and frangible ballast located on a leading edge of said flare-bang projectile, wherein a weight of said ballast is sufficient to provide stability and accuracy in flight, and wherein an at least one material comprising the weighty and frangible ballast is sufficiently frangible such that, after burning of said flare compound and after subsequent detonation of said flash charge, the at least one material comprises low mass, low energy components.

22. The flare-bang projectile of claim 21, wherein the low mass, low energy components comprising the weighty and frangible ballast after detonation are less likely to cause injury to any creature in a vicinity of said detonation.

23. The flare-bang projectile of claim 21, wherein said transfer charge is arranged between the flare and the flash charge, and wherein said transfer charge ignites the flash charge.

24. The flare-bang projectile of claim 23, wherein said transfer charge is located proximate to the flash charge, said transfer charge comprising an igniter composition, wherein said igniter is ignited by the flare compound.

25. The flare-bang projectile of claim 21, wherein the weighty and frangible ballast and flare compound are consolidated.

26. The flare-bang projectile of claim 21, wherein the tubular projectile casing forms a cup and the end of the tubular projectile casing where the weighty and frangible ballast is located forms a solid end of the cup, and wherein the weighty and frangible ballast is consolidated at said solid end of the cup by pressing a ram over the weighty and frangible ballast.

27. The flare-bang projectile of claim 21, wherein the weighty and frangible ballast is secured at the end of the tubular projectile casing by a wad or separation disc.

28. The flare-bang projectile of claim 21, wherein the ratio of zinc powder to graphite powder controls a degree of frangibility of the weighty and frangible ballast.

29. The flare-bang projectile of claim 21, wherein the tubular projectile casing comprises at least one of aluminum, plastic, rubber, and cardboard.

30. The flare-bang projectile of claim 21, wherein the flare-bang cartridge within which the flare-bang projectile fits in order to form a flare-bang assembly further comprises:

a tubular cartridge;

primer at one end of said tubular cartridge;

propellant in said tubular cartridge for launching the flare-bang projectile from said tubular cartridge, said propellant being ignited by said primer; and a pressure wad between said propellant and said projectile.

31. The flare-bang cartridge assembly of claim 21, wherein the projectile further comprises:

a container for the at least one material comprising the weighty and frangible ballast.

32. The flare-bang cartridge assembly of claim 21, wherein the projectile further comprises:

an insulator surrounding the flare compound for providing protection to the projectile from the ignited flare compound.

33. A method of manufacturing a flash-bang cartridge assembly, said flash-bang cartridge assembly comprising a tubular cartridge and a projectile within said tubular cartridge, said method comprising the steps of:

forming a tubular projectile casing;

placing a flare compound at one end of the tubular projectile casing, said flare compound having a starter compound at one end for igniting said flare compound;

placing a transfer charge located at an opposite end of the flare compound, said transfer charge comprising a delay fuse composition;

placing a flash charge within said projectile casing; and placing a weighty, and frangible ballast on a leading edge of said projectile, at an end of the tubular projectile casing opposite from the end having the delay block, wherein a weight of said ballast is sufficient to provide stability and accuracy in flight, and wherein an at least one material comprising the weighty and frangible ballast is sufficiently frangible such that, after burning of the flare compound and subsequent to detonation of said flash charge, the at least one material comprises low mass, low energy components.

34. The method of claim 33, further comprising the step of: consolidating the flare compound within the tubular projectile casing.

35. The method of claim 33, further comprising the step of: consolidating the at least one material comprising the weighty and frangible ballast inside the tubular projectile casing.

36. The method of claim 35, wherein the tubular projectile casing forms a cup and the end of the tubular projectile casing where the weighty and frangible ballast is located forms a solid end of the cup, and wherein said step of consolidating the at least one material comprising the weighty and frangible ballast comprises the step of:

consolidating the at least one material comprising the weighty and frangible ballast at said solid end of the cup by pressing a ram over the at least one material.

37. The method of claim 35, wherein the weighty and frangible ballast remains substantially in place in the end of the tubular projectile casing by means of said consolidation.

38. The method of claim 33, further comprising the step of securing the weighty and frangible ballast at the end of the tubular projectile casing with a wad or separation disc.

39. The method of claim 33, further comprising the step of controlling a degree of frangibility of the weighty and frangible ballast by adjusting components comprising the weighty and frangible ballast.

40. The method of claim 39, further comprising the step of: controlling a burn color of the flare compound by adjusting a quantity of the compounds comprising the flare.

41. The method of claim 33, further comprising the steps of:

placing a primer at one end of said tubular cartridge;

placing propellant in said tubular cartridge; and placing a pressure wad between said propellant and the projectile.

42. The method of claim 41, further comprising the step of: crimping an end of the tubular cartridge opposite from said end of the tubular cartridge having the primer inward to seal the projectile within the tubular cartridge.

43. The method of claim 42, further comprising the step of: placing a closure wad at the end of the tubular cartridge opposite from the primer in order to seal the projectile within the tubular cartridge, wherein said step of crimping at least assists in keeping said closure wad in place.

* * * * *